US010962024B2

(12) United States Patent
Nesteroff et al.

(10) Patent No.: US 10,962,024 B2
(45) Date of Patent: Mar. 30, 2021

(54) CLEARANCE CONTROL SYSTEM FOR A COMPRESSOR SHROUD ASSEMBLY

(71) Applicant: Rolls-Royce Corporation, Indianapolis, IN (US)

(72) Inventors: Michael Nesteroff, Indianapolis, IN (US); Mark Eric Whitlock, Zionsville, IN (US); Nathanael Cooper, Avon, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 98 days.

(21) Appl. No.: 16/452,698

(22) Filed: Jun. 26, 2019

(65) Prior Publication Data

US 2020/0408224 A1 Dec. 31, 2020

(51) Int. Cl.

| | |
|---|---|
| ***F04D 29/16*** | (2006.01) |
| ***F04D 29/62*** | (2006.01) |
| ***F01D 11/22*** | (2006.01) |
| *F04D 29/42* | (2006.01) |

(52) U.S. Cl.

CPC ..... *F04D 29/622* (2013.01); *F01D 11/22* (2013.01); *F04D 29/162* (2013.01); *F04D 29/4206* (2013.01)

(58) Field of Classification Search

CPC .. F04D 29/622; F04D 29/162; F04D 29/4206; F01D 11/22

See application file for complete search history.

(56) References Cited

U.S. PATENT DOCUMENTS

| | | | | |
|---|---|---|---|---|
| 3,818,696 | A * | 6/1974 | Beaufrere | F02C 7/12 60/39.512 |
| 4,195,473 | A * | 4/1980 | Aspinwall | F01D 5/048 60/794 |
| 5,017,088 | A | 5/1991 | Miraucourt et al. | |
| 5,373,691 | A * | 12/1994 | Gardner | F04D 29/462 415/119 |
| 6,626,635 | B1 | 9/2003 | Prowse et al. | |
| 7,079,957 | B2 | 7/2006 | Finnigan et al. | |
| 8,087,880 | B2 | 1/2012 | Karafillis et al. | |
| 9,121,302 | B2 | 9/2015 | Duong et al. | |
| 9,587,507 | B2 | 3/2017 | Ottow | |
| 10,113,556 | B2 | 10/2018 | Moniz et al. | |
| 10,309,409 | B2 * | 6/2019 | Nesteroff | F04D 29/162 |
| 10,352,329 | B2 * | 7/2019 | Nesteroff | F04D 29/622 |
| 10,408,226 | B2 * | 9/2019 | Ottow | F04D 27/0246 |
| 10,704,560 | B2 * | 7/2020 | Aker | F04D 29/4206 |
| 2015/0104335 | A1 * | 4/2015 | Faller | F04D 29/5826 417/244 |
| 2017/0342996 | A1 * | 11/2017 | Nesteroff | F04D 27/0246 |
| 2017/0343001 | A1 * | 11/2017 | Nesteroff | F04D 29/284 |

* cited by examiner

*Primary Examiner* — Michael Lebentritt
(74) *Attorney, Agent, or Firm* — Barnes & Thornburg LLP

(57) ABSTRACT

A compressor shroud assembly is disclosed comprising a dynamically moveable impeller shroud, a static compressor casing, an air piston mounted between said impeller shroud and said compressor casing, and a clearance control system. The air piston effects axial movement of said impeller shroud responsive to a supply of actuating air. The clearance control system regulates the pressure of actuating air in said air piston and comprises a supply conduit having a supply modulating valve and a discharge conduit having a blowoff check valve. The blowoff check valve is set to open at a predetermined differential pressure between pressure of the air piston and pressure of the supply of actuating air.

20 Claims, 4 Drawing Sheets

CLEARANCE CONTROL SYSTEM FOR A COMPRESSOR SHROUD ASSEMBLY

BACKGROUND

Centrifugal compressors are used in turbine machines such as gas turbine engines to provide high pressure working fluid to a combustor. In some turbine machines, centrifugal compressors are used as the final state in a multi-stage high-pressure gas generator.

A typical centrifugal compressor comprises a rotatable impeller that is at least partly encased by a shroud assembly. Maintaining a sufficient clearance or gap between the impeller and the shroud assembly is essential to successful operation of the centrifugal compressor. A failure to maintain the clearance may result in damage to the centrifugal compressor and/or degradation of performance.

SUMMARY

According to some aspects of the present disclosure, a compressor shroud assembly comprises a dynamically moveable impeller shroud, a static compressor casing, an air piston, and a clearance control system. The impeller shroud at least partly encases a rotatable impeller. The air piston is mounted between the impeller shroud and the compressor casin. The air piston effects axial movement of the impeller shroud responsive to actuating air. The clearance control system regulates the pressure of actuating air in the air piston. The clearance control system comprises a supply conduit extending from an actuating air supply chamber to the air piston and having a supply modulating valve positioned in the supply conduit for regulating the flow of actuating air to and from the air piston, and a blowoff conduit having a check valve positioned in the blowoff conduit. The check valve is set to allow actuating air discharge from the air piston at a predetermined differential pressure between the air piston and the actuating air supply chamber.

In some embodiments the actuating air supply chamber is a chamber that captures effluent discharged from a centrifugal compressor. In some embodiments the blowoff conduit discharges to the actuating air supply chamber. In some embodiments the blowoff conduit discharges to ambient.

In some embodiments the compressor shroud assembly further comprises one or more heat exchangers positioned in the supply conduit. In some embodiments the air piston comprises a forward member, an aft member, and a central flex member collectively defining a piston chamber. In some embodiments the central flex member comprises a hoop having a U-shaped cross section. In some embodiments the central flex member comprises a bellows forming a hoop. In some embodiments the impeller shroud is mounted to the air piston proximate an aft end of the impeller shroud.

According to further aspects of the present disclosure, a clearance control system is disclosed for regulating a fluid pressure in an air piston of a centrifugal compressor shroud assembly. The air piston is coupled between a static compressor casing and a dynamically moveable impeller shroud. The clearance control system comprises a supply conduit, a supply modulating valve, a blowoff conduit, and a blowoff check valve. The supply conduit extends from a first chamber to the air piston. The supply modulating valve is positioned in the supply conduit to regulate a fluid flow to and from the air piston. The blowoff conduit extends from the air piston. The blowoff check valve is positioned in the blowoff conduit and is set to open at a predetermined blowoff differential pressure between the air piston and the first chamber.

In some embodiments the clearance control system further comprises a supply check valve positioned in fluid communication with the supply conduit, the supply check valve set to open at a predetermined supply differential pressure between the air piston and the first chamber, the supply check valve discharging to one of the first chamber and ambient.

In some embodiments the predetermined blowoff differential pressure is the same as the predetermined supply differential pressure. In some embodiments the blowoff check valve discharges to one of the first chamber and ambient. In some embodiments the first chamber is an actuating air supply chamber. In some embodiments the actuating air supply chamber is a chamber that captures effluent discharged from a centrifugal compressor.

According to further aspects of the present disclosure, a method is disclosed for regulating a fluid pressure in a pressure-actuated air piston of a centrifugal compressor shroud assembly. The method comprises mounting the pressure-actuated air piston to a static casing; mounting a shroud to the air piston; supplying actuating air from an actuating air supply chamber to the air piston via a supply conduit in fluid communication with the air piston; and positioning a check valve in a blowoff conduit in fluid communication with the air piston, the check valve set to open at a predetermined differential pressure between the air piston and the actuating air supply chamber.

In some embodiments the method further comprises discharging actuating air from the blowoff conduit to the actuating air supply chamber. In some embodiments the method further comprises discharging actuating air from the blowoff conduit to ambient. In some embodiments the method further comprises capturing effluent discharged from a centrifugal compressor in the actuating air supply chamber. In some embodiments the method further comprises treating actuating air supplied to the air piston with one or more heat exchangers positioned in the supply conduit.

BRIEF DESCRIPTION OF THE DRAWINGS

The following will be apparent from elements of the figures, which are provided for illustrative purposes.

Figure 1:
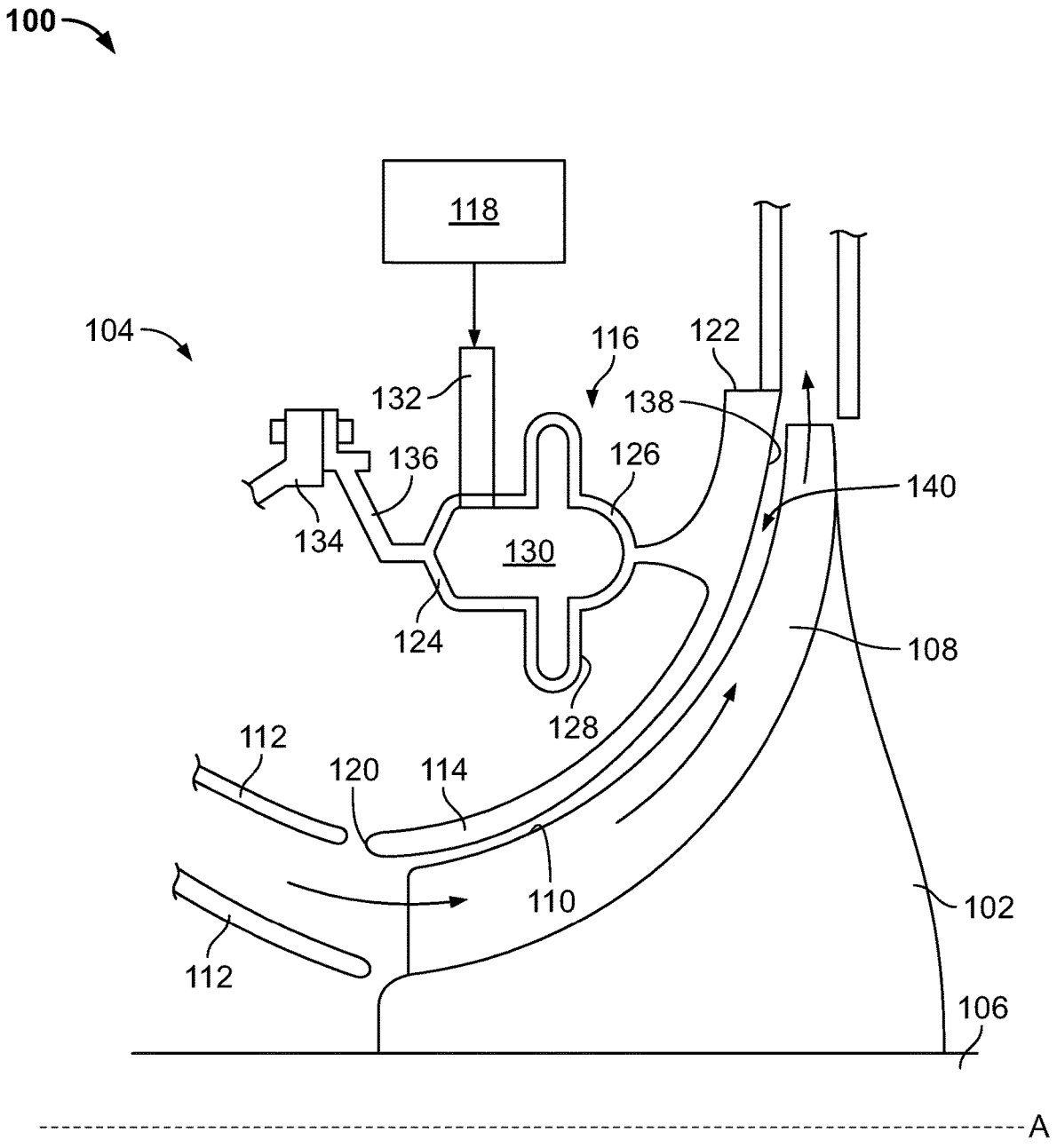
FIG. 1 is a schematic and cross-sectional view of a centrifugal compressor.

The present application discloses illustrative (i.e., example) embodiments. The claimed inventions are not limited to the illustrative embodiments. Therefore, many implementations of the claims will be different than the illustrative embodiments. Various modifications can be made to the claimed inventions without departing from the spirit and scope of the disclosure. The claims are intended to cover implementations with such modifications.

DETAILED DESCRIPTION

For the purposes of promoting an understanding of the principles of the disclosure, reference will now be made to a number of illustrative embodiments in the drawings and specific language will be used to describe the same.

In order to maintain a sufficient clearance between the rotatable impeller and the shroud assembly of a centrifugal compressor, the shroud assembly may be dynamically moveable such that the shroud is able to be positioned relative to the impeller based on various operating parameters to ensure the safe and efficient operation of the centrifugal compressor. An example of one such dynamically moveable shroud is described with reference to FIG. 1. In some embodiments, the dynamically moveable shroud is as described in U.S. Pat. No. 10,309,409 the entirety of which is hereby incorporated by reference.

FIG. 1 is a schematic and cross-sectional view of a centrifugal compressor 100. Centrifugal compressor 100 comprises a rotatable centrifugal impeller 102 at least partly encased by a shroud assembly 104.

Centrifugal impeller 102 is coupled to a shaft 106 rotatable about an axis of rotation A. Centrifugal impeller 102 comprises a plurality of blades 108 extending radially and axially outward from the impeller 102 and terminating in blade tips 110. As blade 108 rotates, it receives working fluid at an inlet pressure and ejects working fluid at a discharge pressure which is higher than the inlet pressure. Working fluid (e.g. air in a gas turbine engine) is directed to the centrifugal impeller 102 by an inlet casing 112. The working fluid may be discharged from a multi-stage axial compressor (not shown) prior to entering the region about the centrifugal impeller 102. Arrows illustrate the flow of working fluid along the blades 108.

Shroud assembly 104 may comprise a dynamically moveable impeller shroud 114, an air piston 116, and a high pressure air source 118. Shroud 114 may at least partly encase the centrifugal impeller 102 and may extend from an inlet end 120 to an outlet end 122. Shroud 114 comprises a radially inner surface 138 that faces the centrifugal impeller 102

Air piston 116 is adapted to receive air from an actuating air source 118 and to actuate and/or axially translate responsive to the supply and/or discharge of actuating air. Air piston may comprise a forward member 124, an aft member 126, and a central flex member 128 disposed between the forward member 124 and aft member 126. The forward member 124, aft member 126, and central flex member 128 collectively may define a piston chamber 130. The central flex member 128 may comprise a ring or hoop having a U-shaped cross section, or may comprise a bellows forming a hoop. The central flex member 128 may be adapted to expand, contract, and/or flex primarily in an axial direction such that expansion and contraction of the air piston 116 results in substantially axial movement of, for example, the aft member 126. The air piston 116 may receive actuating air from the actuating air source 118 via a receiving chamber 132 or tube. The air piston 116 may be a single annular piston or may comprise a plurality of discrete pistons spaced circumferentially about the axis of rotation A and/or about the shroud 114.

The forward member 124 may be affixed to a static casing 134 by a forward arm 136. The static casing 134 and forward arm 136 may rigidly hold the forward member 124 such that actuation of the air piston 116 results in axial motion of the aft member 126. Aft member 126 may be affixed to shroud 114 proximate outlet end 122. Air piston 116 may therefore be mounted between static casing 134 and shroud 114.

The space between blade tips 110 of the centrifugal impeller 102 and surface 138 of the shroud 114 is the blade tip clearance 140. During operation of the centrifugal compressor 100, thermal, mechanical, and pressure forces act on the various components of the centrifugal compressor 100 causing variation in the blade tip clearance 140. Sufficient blade tip clearance 140 is required to prevent rubbing between blade tips 110 and surface 138, which can damage or degrade performance of the centrifugal compressor 100. However, excessive blade tip clearance 140 is undesirable as it results in high leakage rates past the centrifugal impeller 102 and thus reduces efficiency of the centrifugal compressor 100. It is therefore desirable to control the blade tip clearance 140 over a wide range of steady state and transient operating conditions.

The disclosed shroud assembly 104 is generally effective to control blade tip clearance 140. Actuating air may be supplied to cause expansion of the air piston 116, thus causing axially aft movement of the shroud 114 to position the shroud 114 closer to the blade tips 110 and reduce the blade tip clearance 140. Actuating air may also be discharged or vented from the air piston 116, thus causing axially forward movement of the shroud 114 to position the shroud 114 further from the blade tips 110 and increase blade tip clearance 140. Blade tip clearance 140 may be actively monitored (for example, by sensors), or actuating air may be supplied and discharged to/from the air piston 116 based on operating parameters of the rotating machine and/or a parametric schedule.

Although the shroud assembly 104 may be generally effective to control blade tip clearance 140, certain operating conditions remain problematic and may result in rubbing blade tips 110 against surface 138. One such condition is a surge condition. During a compressor surge, the region about the rotating impeller 102 may rapidly depressurize, leading to unstable flow through the region and/or reversal of flow. Depressurization in the region about the rotating impeller 102 may cause an axially aft movement of the shroud 114 and lead to rubbing or a more violent impact between the blade tips 110 and the shroud 114. Existing systems for monitoring blade tip clearance 140 generally fail to detect a surge condition and reposition the shroud 114 in time to avoid blade tip rub. Improvements are therefore desired to clearance control systems to provide a sufficiently reactive shroud control to avoid blade tip rub during a compressor surge.

Figure 2:
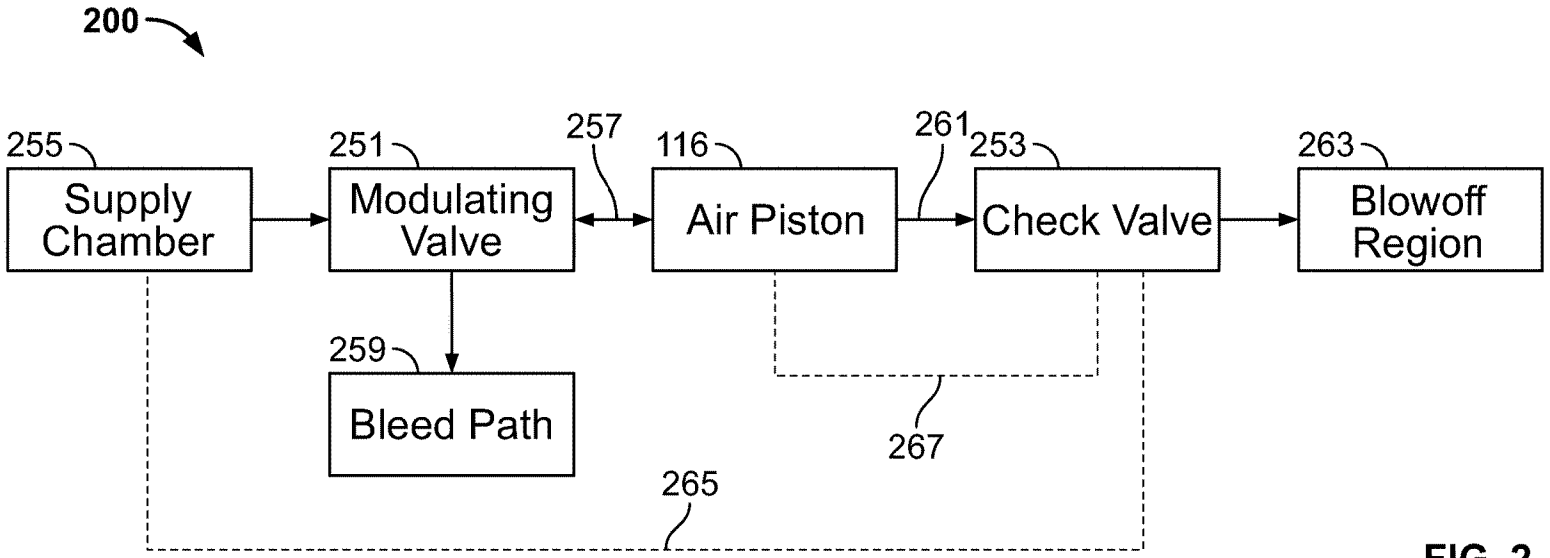
FIG. 2 is a block diagram of a clearance control system in accordance with some embodiments of the present disclosure.

FIG. 2 is a block diagram of a clearance control system 200 in accordance with some embodiments of the present disclosure. The clearance control system 200 may comprise an actuating air supply chamber 255, a modulating valve 251, the air piston 116 as described above, and a check valve 253. The clearance control system 200 may regulate the pressure of actuating air in the air piston 116.

Actuating air supply chamber 255 may comprise an actuating air source 118. The supply chamber 255 may store a volume of relatively high pressure actuating air or fluid. The supply chamber 255 may be a chamber that receives discharge of the centrifugal compressor, or may receive relatively high pressure air from another source. The actuating air supply chamber 255 may be in fluid communication with the air piston 116 via a supply conduit 257.

The modulating valve 251 may be disposed in the supply conduit 257 between the actuating air supply chamber 255 and the air piston 116. The modulating valve 251 may regulate the flow of actuating air to and from the piston chamber 130 of the air piston 116. By controlling the flow of actuating air into and out of the piston chamber 130, the modulating valve 251 controls the pressure of fluid in the piston chamber 130 and thus the relative expansion or contraction of the air piston 116. As described with reference to FIG. 1 above, control of the expansion or contraction of the air piston 116 results in control of the axial position of the shroud 114 relative to the blade tips 110.

The modulating valve 251 may open or throttle open to supply actuating air to the piston chamber 130. The modulating valve may shut to stop the flow of actuating air and maintain existing fluid pressure of the piston chamber 130. The modulating valve may open or throttle open to allow discharge or bleed of actuating air from the air piston 116. For example, the modulating valve 251 may be a three-way valve that allows actuating air to flow into the piston chamber 130 from the actuating air supply chamber 255 and allows actuating air to flow out of the piston chamber 130 to a separate bleed path 259. Modulating valve 251 may also allow two-way flow between the actuating air supply chamber 255 and piston chamber 130 driven by differential pressure.

A blowoff conduit 261 may extend from the piston chamber 130 of the air piston 116. The blowoff conduit 261 may extend between the piston chamber 130 and a blowoff region 263. The blowoff region 263 may be a chamber that receives discharge of the centrifugal compressor, the actuating air supply chamber 255, the atmosphere surrounding the centrifugal compressor (i.e. ambient), or another chamber that may receive blowoff from the piston chamber 130. Blowoff to ambient may result in a faster discharge from the blowoff conduit 261 owing to the large differential pressure between fluid in the blowoff conduit 261 and ambient pressure. In some embodiments blowoff conduit 261 is dimensioned to ensure that the discharge of actuating air from the piston chamber 130 and/or supply conduit 257 will outpace the supply of actuating air from the actuating air supply chamber 255.

A check valve 253 may be positioned in the blowoff conduit 261. Check valve 253 may be referred to as a blowoff check valve 253. The check valve 253 may regulate the blowoff of actuating air from the piston chamber 130 as needed. The check valve 253 may receive a first input 265 indicating the fluid pressure of the actuating air supply chamber 255. The check valve 253 may receive a second input 267 indicating the fluid pressure of the piston chamber 130 of the air piston 116. The first and second inputs 265, 267 may be pneumatic, electric, electronic, or another type of input that may be received at the check valve 253.

The check valve 253 may be set to open and therefore to permit actuating air to discharge rapidly (i.e. to blowoff) from the piston chamber 130 at a predetermined differential pressure between a pair of fluid pressures. For example, the check valve 253 may be set to open at a predetermined differential pressure between the actuating air supply chamber 255 and the piston chamber 130 of the air piston 116. The predetermined differential pressure may be determined as an indication of compressor surge, such as a differential pressure caused by depressurization of the region surrounding the impeller 102. The predetermined differential pressure may be when the pressure of fluid in the actuating air supply chamber 255 is less than the pressure of fluid in the piston chamber 130. When the first input 265 and second input 267 indicate the predetermined differential pressure, the check valve 253 will open to cause a rapid discharge to the blowoff region 263. The check valve 253 may be set to shut after opening at a second predetermined differential pressure between the actuating air supply chamber 255 and the piston chamber 130 of the air piston 116. Thus, in the disclosed embodiments the fluid pressure in the actuating air supply chamber 255 is used as a regulating pressure of the check valve 253; however, in some embodiments other fluid pressures may be used as regulating pressures of the check valve 253.

In some embodiments check valve 253 receives first and second inputs 265, 267 as pneumatic inputs and check valve 253 is mechanically set to open at a predetermined differential pressure between the first and second inputs 265, 267. Such an embodiment advantageously removes any lag time from a control circuit and allows check valve 253 to respond immediately to a differential pressure indicating a surge condition.

The rapid discharge of actuating air from the piston chamber 130 by opening check valve 253 results in a rapid axially forward movement of the shroud 114 away from the blade tips 110 as the piston chamber 130 contracts, and a rapid convergence of the pressures in the region about the impeller 102 and the piston chamber 130. The rapid discharge of actuating air from the piston chamber 130 therefore prevents and/or reduces the likelihood of impingement of the blade tips 110 on shroud 114. To the extent impingement may occur, the severity of the impingement and damage or degradation caused by the impingement would be reduced.

Figure 3:
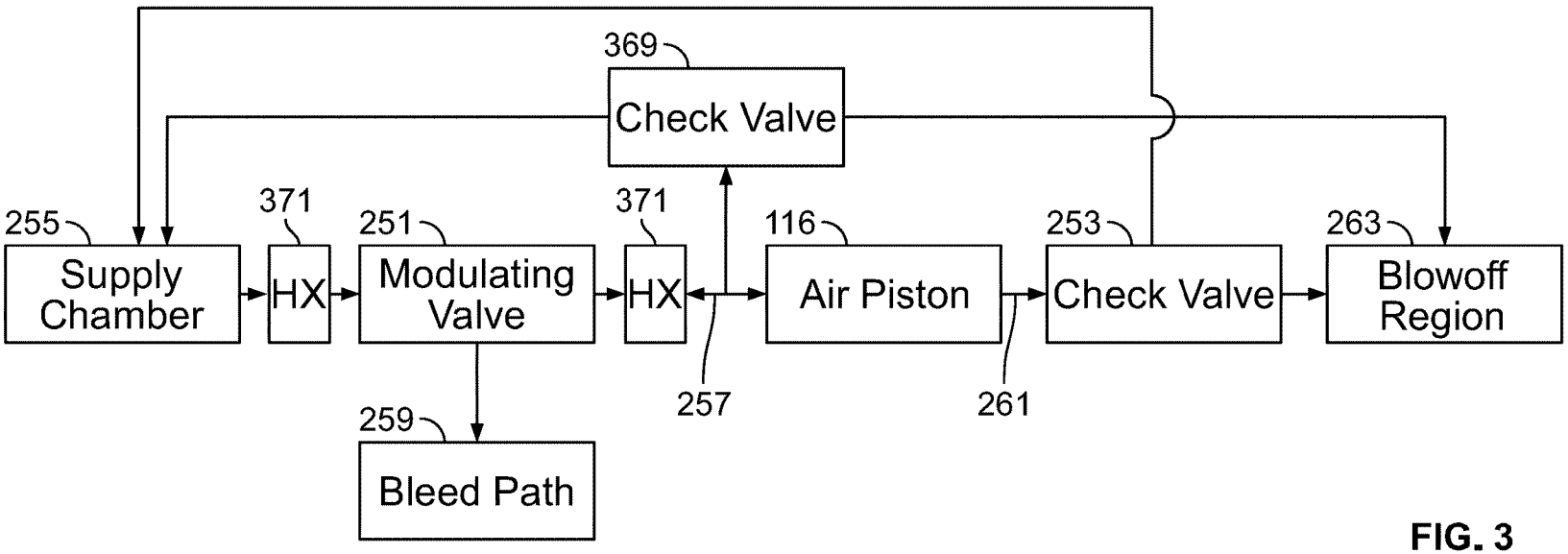
FIG. 3 is a block diagram of a clearance control system in accordance with some embodiments of the present disclosure.

FIG. 3 is a block diagram of a clearance control system 200 in accordance with some embodiments of the present disclosure. As described above with reference to FIG. 2, the clearance control system 200 may comprise an actuating air supply chamber 255, a modulating valve 251, the air piston 116 as described above, and a check valve 253. The clearance control system 200 may regulate the pressure of actuating air in the air piston 116.

In the embodiment of FIG. 3, clearance control system 200 comprises a blowoff check valve 253 and a supply check valve 369. As described above, blowoff check valve 253 may receive a first input 265 indicating the fluid pressure of actuating air supply chamber 255 and a second input 267 indicating the fluid pressure of the piston chamber 130 of the air piston 116. Blowoff check valve 253 may be set to open—thus discharging actuating air from the piston chamber 130 and blowoff conduit 261—at a predetermined differential pressure between the actuating air supply chamber 255 and the piston chamber 130. Blowoff check valve 253 may discharge to a blowoff region 263 or to actuating air supply chamber 255.

Supply check valve 369 may be positioned in fluid communication with supply conduit 257. Like the blowoff check valve 253, supply check valve 369 may receive a first input 265 indicating the fluid pressure of actuating air supply chamber 255 and a second input 267 indicating the fluid pressure of the piston chamber 130 of the air piston 116. Supply check valve 369 may be set to open—thus discharging actuating air from the piston chamber 130 and supply conduit 257—at a predetermined differential pressure between the actuating air supply chamber 255 and the piston chamber 130. The predetermined differential pressure setpoint of the supply check valve 369 may be the same as the predetermined differential pressure setpoint of the blowoff check valve 253. The supply check valve 369 may therefore function to assist with rapid depressurization and blowoff of the piston chamber 130, supply conduit 257, and modulating valve 251. Supply check valve 369 may discharge to a blowoff region 263 or to actuating air supply chamber 255.

In the embodiment of FIG. 3, clearance control system 200 may further comprise one or more heat exchangers 371 positioned in the supply conduit 257. In the illustrated embodiment, a heat exchanger 371 is positioned between actuating air supply chamber 255 and modulating valve 251, and a heat exchanger is positioned between modulating valve 251 and air piston 116. Heat exchangers 371 may treat actuating air supplied to the piston chamber 130.

Figure 4:
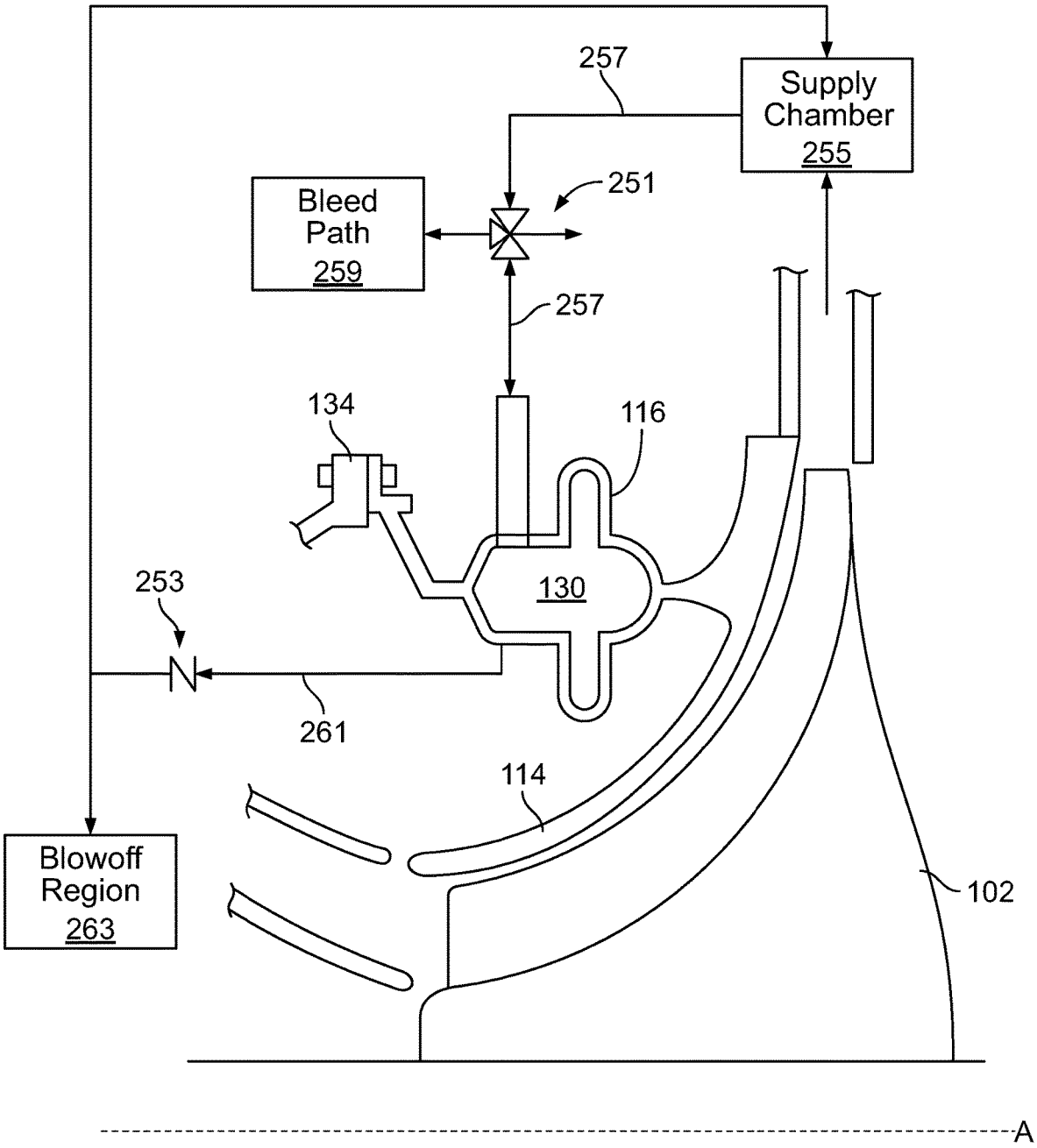
FIG. 4 is a combined schematic and cross-sectional view of a centrifugal compressor having a clearance control system in accordance with some embodiments of the present disclosure.

FIG. 4 is a combined schematic and cross-sectional view of a centrifugal compressor 100 having a clearance control system 200 in accordance with some embodiments of the present disclosure. FIG. 4 combines the disclosed centrifugal compressor 100 of FIG. 1 with the disclosed clearance control system 200 of FIG. 2.

Figure 5:
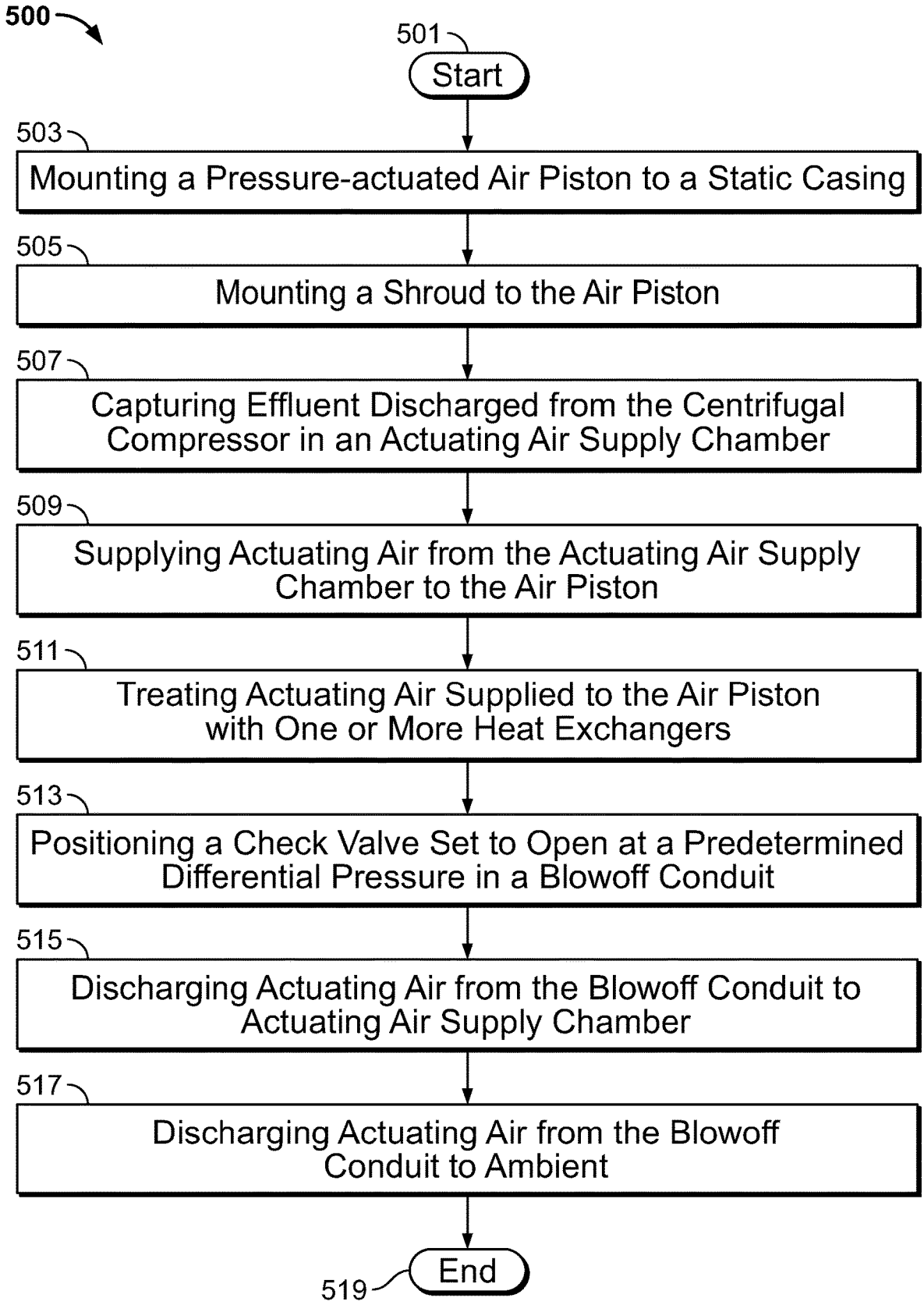
FIG. 5 is a flow diagram of a method in accordance with some embodiments of the present disclosure.

FIG. 5 is a flow diagram of a method 500 of regulating fluid pressure in an air piston of a centrifugal compressor shroud assembly 104 in accordance with some embodiments of the present disclosure. Method 500 starts at Block 501. The steps of method 500, presented at Blocks 501 through 519, may be performed in the order presented in FIG. 5 or in another order. One or more steps of the method 500 may not be performed.

At Block 503 a pressure-actuated air piston 116 may be mounted to a static casing 134. Air piston 116 may be adapted to receive air from an actuating air source 118 and to actuate and/or axially translate responsive to the supply and/or discharge of actuating air. Air piston 116 may define a piston chamber 130.

An impeller shroud 114 may be mounted to the air piston 116 at Block 505. The impeller shroud 114 may be mounted to the air piston 116 proximate an aft end of the impeller shroud 114. The impeller shroud 114 may axially translate with the axial translation of the air piston 116. Axial translation of the impeller shroud 114 may alter the clearance between the impeller shroud 114 and blade tips 110 of an impeller 102 of the centrifugal compressor 100.

At Block 507 a portion of the effluent of the centrifugal compressor may be captured in the actuating air supply chamber 255 for use as actuating air.

At Block 509 actuating air may be supplied from the actuating air supply chamber 255 to the piston chamber 130 of the air piston 116 The actuating air may be supplied through a supply modulating valve 251 positioned in a supply conduit 257 that couples the actuating air supply chamber 255 to the piston chamber 130. The actuating air may actuating the air piston 116 causing axially translation of the air piston 116 and shroud 114.

The actuating air supplied to the piston chamber 130 may be treated by one or more heat exchangers 371 prior to entering the piston chamber 130 at Block 511. The heat exchangers 371 may be positioned in supply conduit 257.

At Block 513 a check valve 253 may be positioned in a blowoff conduit 261 extending from the piston chamber 130 of air piston 116. The check valve 253 may be set to open at a predetermined differential pressure. Opening of the check valve 253 may result in discharge of actuating air from the piston chamber 130. The predetermined differential pressure may be determined by comparing the pressure of fluid in the actuating air supply chamber 255 with the pressure in the piston chamber 130.

Actuating air discharged from the piston chamber 130 may be directed to the actuating air supply chamber 255 and/or to ambient, as indicated at Blocks 515 and 517.

Method 500 ends at Block 519.

The presently disclosed systems and methods of blade tip clearance control have numerous advantages over prior systems and methods. Most notably, the clearance control system of the present disclosure may provide a pneumatic actuation system for a check valve to conduct blowoff of the piston chamber. This system may therefore eliminate the lag time associated with a sensors-and-processors based system, and will enable a quicker response time during a compressor surge condition. This quicker response time allows for depressurizing the piston chamber and rapid axially forward movement of the shroud away from the impeller, thus reducing or eliminating impingement.

Although examples are illustrated and described herein, embodiments are nevertheless not limited to the details shown, since various modifications and structural changes may be made therein by those of ordinary skill within the scope and range of equivalents of the claims.

What is claimed is:

1. A compressor shroud assembly comprising:
- a dynamically moveable impeller shroud at least partly encasing a rotatable impeller;
- a static compressor casing;
- an air piston mounted between said impeller shroud and said compressor casing, said air piston effecting axial movement of said impeller shroud responsive to actuating air; and
- a clearance control system regulating the pressure of actuating air in said air piston, said clearance control system comprising:
  - a supply conduit extending from an actuating air supply chamber to the air piston and having a supply modulating valve positioned in said supply conduit for regulating the flow of actuating air to and from said air piston; and
  - a blowoff conduit having a check valve positioned in said blowoff conduit, said check valve set to allow actuating air discharge from the air piston at a predetermined differential pressure between the air piston and the actuating air supply chamber.

2. The compressor shroud assembly of claim 1 wherein said actuating air supply chamber is a chamber that captures effluent discharged from a centrifugal compressor.

3. The compressor shroud assembly of claim 1 wherein said blowoff conduit discharges to said actuating air supply chamber.

4. The compressor shroud assembly of claim 1 wherein said blowoff conduit discharges to ambient.

5. The compressor shroud assembly of claim 1 further comprising one or more heat exchangers positioned in said supply conduit.

6. The compressor shroud assembly of claim 1 wherein said air piston comprises a forward member, an aft member, and a central flex member collectively defining a piston chamber.

7. The compressor shroud assembly of claim 6 wherein said central flex member comprises a hoop having a U-shaped cross section.

8. The compressor shroud assembly of claim 6 wherein said central flex member comprises a bellows forming a hoop.

9. The compressor shroud assembly of claim 1 wherein said impeller shroud is mounted to said air piston proximate an aft end of the impeller shroud.

10. A clearance control system for regulating a fluid pressure in an air piston of a centrifugal compressor shroud assembly, said air piston coupled between a static compressor casing and a dynamically moveable impeller shroud, said clearance control system comprising:

a supply conduit extending from a first chamber to said air piston;

a supply modulating valve positioned in said supply conduit to regulate a fluid flow to and from said air piston;

a blowoff conduit extending from said air piston; and a blowoff check valve positioned in said blowoff conduit, said blowoff check valve set to open at a predetermined blowoff differential pressure between the air piston and the first chamber.

11. The clearance control system of claim 10 further comprising a supply check valve positioned in fluid communication with said supply conduit, said supply check valve set to open at a predetermined supply differential pressure between the air piston and the first chamber, said supply check valve discharging to one of the first chamber and ambient.

12. The clearance control system of claim 11 wherein said predetermined blowoff differential pressure is the same as said predetermined supply differential pressure.

13. The clearance control system of claim 10 wherein the blowoff check valve discharges to one of the first chamber and ambient.

14. The clearance control system of claim 10 wherein the first chamber is an actuating air supply chamber.

15. The clearance control system of claim 14 wherein said actuating air supply chamber is a chamber that captures effluent discharged from a centrifugal compressor.

16. A method of regulating a fluid pressure in a pressure-actuated air piston of a centrifugal compressor shroud assembly, said method comprising:

mounting the pressure-actuated air piston to a static casing;

mounting a shroud to the air piston;

supplying actuating air from an actuating air supply chamber to the air piston via a supply conduit in fluid communication with the air piston; and positioning a check valve in a blowoff conduit in fluid communication with the air piston, said check valve set to open at a predetermined differential pressure between the air piston and the actuating air supply chamber.

17. The method of claim 16 further comprising:

discharging actuating air from the blowoff conduit to the actuating air supply chamber.

18. The method of claim 16 further comprising:

discharging actuating air from the blowoff conduit to ambient.

19. The method of claim 16 further comprising:

capturing effluent discharged from a centrifugal compressor in the actuating air supply chamber.

20. The method of claim 16 further comprising:

treating actuating air supplied to the air piston with one or more heat exchangers positioned in said supply conduit.

* * * * *